United States Patent [19]

Lu

[11] Patent Number: 4,697,394

[45] **Date of Patent: * Oct. 6, 1987**

[54] GROUND ANCHOR WITH RECOVERABLE STEEL RODS

[76] Inventor: Hsi H. Lu, No. 2-6, Alley 17, Lane 76, Sec. 2, Ho Ping E Rd., Taipei, Taiwan

[ * ] Notice: The portion of the term of this patent subsequent to Jun. 3, 2003 has been disclaimed.

[21] Appl. No.: 892,841

[22] Filed: Aug. 4, 1986

[51] Int. Cl.[4] ..... E02D 5/74

[52] U.S. Cl. ..... 52/162; 411/432

[58] Field of Search ..... 52/155, 156, 157, 158, 52/159, 160, 161, 162, 163, 164, 165, 166; 166/202, 272, 273, 284; 175/320; 411/432, 437, 427

[56] References Cited

U.S. PATENT DOCUMENTS 1,920,141 7/1935 Fischer ..... 411/432

4,592,178 6/1986 Lu ..... 52/162 X

*Primary Examiner*—William F. Pate, III

*Assistant Examiner*—Creighton Smith

*Attorney, Agent, or Firm*—Fleit, Jacobson, Cohn & Price

[57] ABSTRACT

Disclosed herein an improved ground anchor with recoverable steel rods which is characterized by the design of a socket having a plurality of tapered holes for fixing of steel rods from the top and two semi-conical wedges at the bottom of each hole to fix the steel rods by frictional force. The fixing holes are designed with external wall having tensile strength smaller than that of the steel rods so that application of any normal extractor to pull out the steel rods will distort and break the external wall of the holes first, the friction among the semi-conical wedges and steel rods will be overcome consequently, and thus the steel rods can be extracted and recovered easily. It is further characterized by the design of swingable arms, each with a left cutting edge in a form of slightly turning outward for cutting earth in order to ease its extension, and a recession at the external curved surface to reduce friction between the swingable arm and the earth. In case it is to be used at any place without ground water, drill bit, spring and spring-loaded ball may be omitted and a plurality of triangular blades can be installed at the front of the anchor head so that it can function as a drill bit simultaneously in order to lower construction cost.

3 Claims, 6 Drawing Figures

GROUND ANCHOR WITH RECOVERABLE STEEL RODS

BACKGROUND OF THE INVENTION

The present invention is an improvement of the inventor's invention applied for a Letter Patent under Ser. No. 721,369 filed on April 9, 1985 which you notified your approval of patent granting on Oct. 28, 1985. The structure in the said invention mainly involved the use of a thrust bearing fixed to a socket for a plurality of steel rods so that the socket will not rotate following rotation of the ground anchor and connecting tubes to penetrate the ground anchor can be recovered one by one, only the steel rods and anchor head will be left behind in the earth in order to increase holding force of the ground anchor. However, if the ground anchor is to be extended to neighbor land belonging to any other party, recovery of the steel rods will be very difficult since they are welded to the fixing holes of the socket. Furthermore, the inventor's prior invention disclosed an anchor head structure with a plurality of curved swingable arms hinged at appropriate position. When the swingable arms are closed, the swingable arms are tightly held around the rear end of the anchor head. It is necessary to withdraw the ground anchor to a certain extent or to flush them with water to help their extension. Their extension will encounter problem if they are in earth with considerable hardness, and there is a considerable friction between their curved external surfaces and the earth during the extension. The prior invention has a drill bit fixed to the front end of the anchor head with a spring and a spring-loaded ball between the drill bit and the front end to prevent from back flow of ground water. The spring and spring-loaded ball are unnecessary for application at any place without ground water.

SUMMARY OF THE INVENTION

In view of the aforesaid defects, the inventor created the present invention.

The main objective of the present invention is to provide an improved ground anchor with recoverable steel rods which does not only have the functions of the prior invention but recoverable steel rods in order to avoid infringement on right over neighbor land after application of the ground anchor.

Another objective of the present invention is to provide an improved ground anchor with recoverable steel rods as well as easily extendable swingable arms and minimum friction between it and the earth.

Furthermore, the present invention provides an anchor head with a plurality of triangular blades welded to its front end directly for function as a drill bit without the need for separate installation of other drill bit.

The present invention mainly comprises an anchor head, a plurality of swingable arms, a hollow rod, a double threaded nut, a thrust bearing and a socket as well as a plurality of connectors and connecting tubes to extend the ground anchor to a desired depth. It is characterized by the design of the socket which has a plurality of tapered holes for fixing of steel rods from the top and two semi-conical wedges at the bottom of each hole to fix the steel rods by frictional force. The fixing holes are designed with external wall having tensile strength smaller than that of the steel rods so that application of any normal extractor to pull out the steel rods will distort and break the external wall of the holes first, the friction among the semi-conical wedges and steel rods will be overcome consequently, and thus the steel rods can be extracted and recovered easily. It is further characterized by the design of swingable arms, each with a left cutting edge in a form of slightly turning outward for cutting earth in order to ease its extension, and a recession at the external curved surface to reduce friction between the swingable arm and the earth. In case it is to be used at any place without ground water, drill bit, spring and spring-loaded ball may be omitted and a plurality of triangular blades can be installed at the front end of the anchor head so that it can function as a drill bit simultaneously in order to lower construction cost.

DETAILED DESCRIPTION OF A PREFERRED EMBODIMENT

Figure 1:
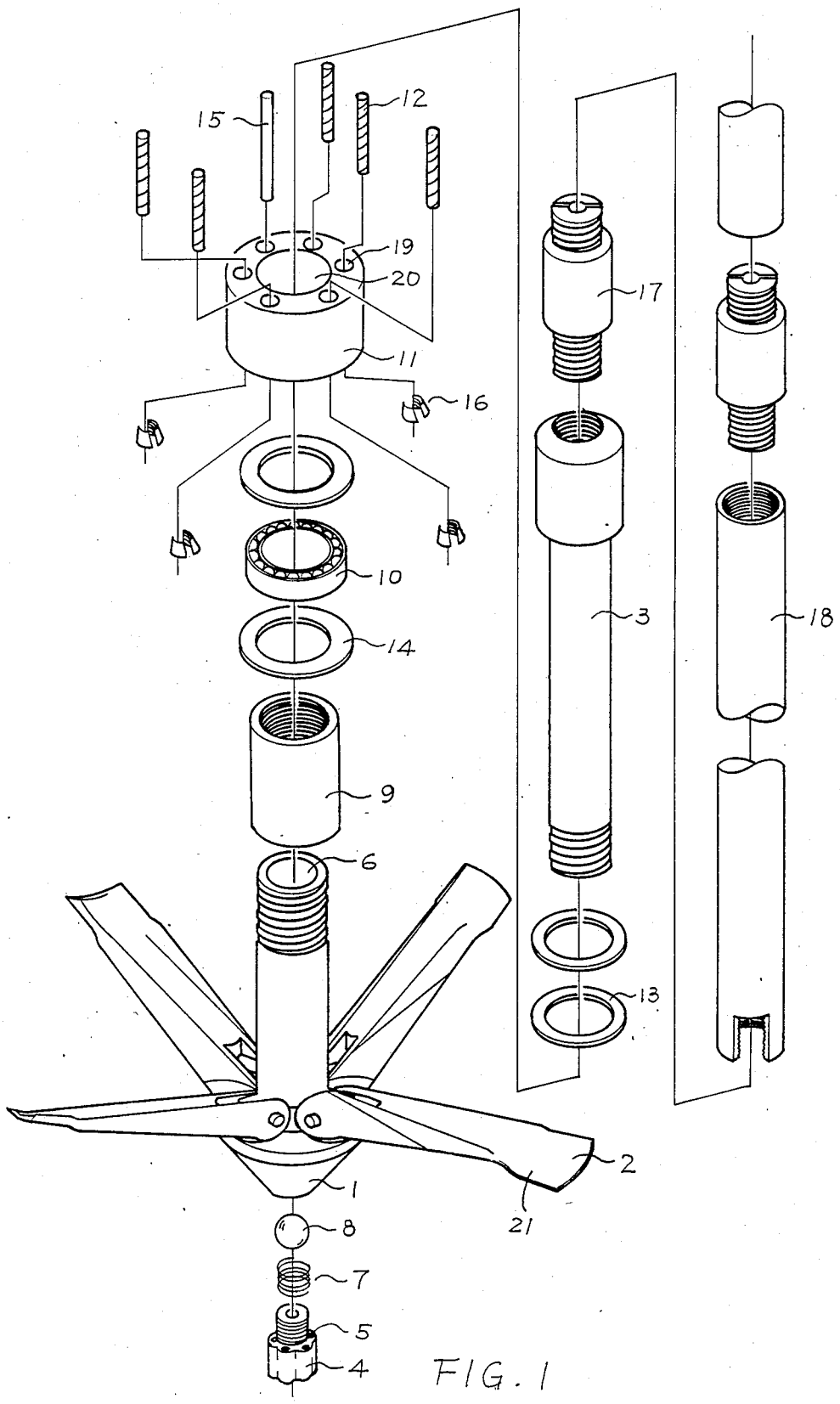
FIG. 1 is a fragmental view of the present invention.
Figure 2:
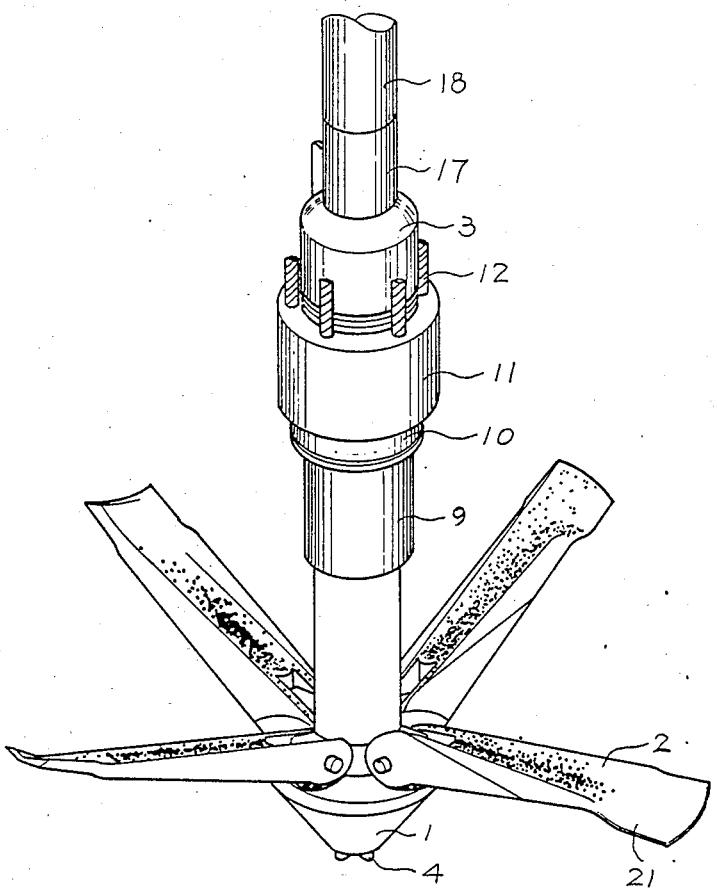
FIG. 2 illustrates the appearance of the present invention.
Figure 3:
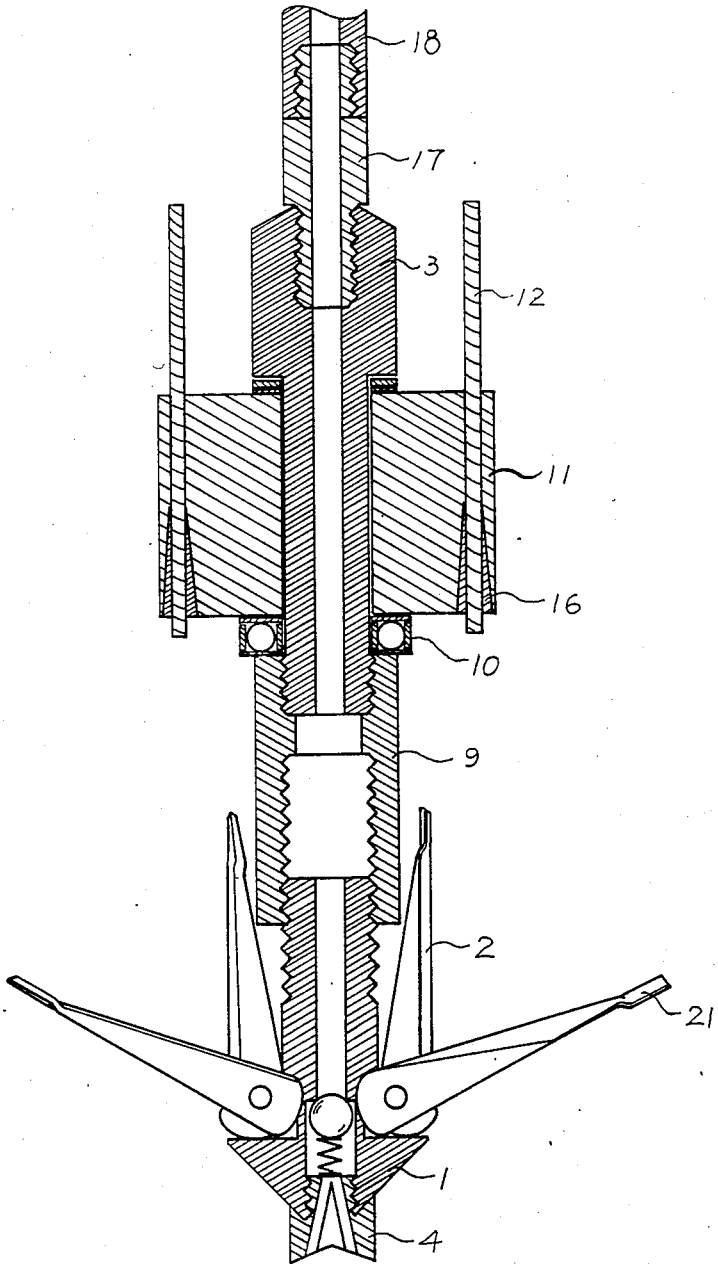
FIG. 3 is a sectional view of the present invention.

As shown in the attached drawings, the present invention comprises mainly an anchor head 1, a plurality of swingable arms 2, a hollow rod 3, a double threaded nut 9, a thrust bearing 10 and a socket 11. It can be extended to any desired depth of anchorage by means of some connectors 17 and connecting tubes 18. The tip of the anchor head 1 is tapped with inner thread for connecting to a drill bit 4 which has a water outlet 5 connecting to the water route 6 passing through the central line of the anchor head 1 so that water can flow out of the ground anchor. The rear end of the anchor head 1 has an outer thread connecting to the double threaded nut 9 while another end of the double threaded nut 9 is connected to the hollow rod 3. A washer 13, a socket 11, another washer 14 and a thrust bearing 10 are put before the hollow rod 3 is connected to the double threaded nut 9. Since the hollow rod 3 has an end with diameter larger than that at the other end, connection of the double threaded nut 9 to the hollow rod 3 will restrict the washer 13, socket 11, washer 14 and thrust bearing 10 to the smaller end of the hollow rod 3. Since the central shaft hole 20 of the socket 11 has an inner diameter slightly greater than the outer diameter of the hollow rod 3, and the thrust bearing 10 is beneath the socket 11, rotation and extending of the ground anchor will not cause the socket 11 to rotate simultaneously and thus friction between them will be minimized. The larger end of the hollow rod 3 is tapped with inner thread for connection of a connector 17. A hole with a diameter slightly larger than that of the water route 6, in front of the water route 6 of the anchor head 1, is designed to hold a spring-loaded ball 8 and a spring 7 with an end keeping in touch with the drill bit 4 and another end in touch with the ball 8 to close the water route 6 in order to prevent from back flow of ground water.

The above structural characteristics have been described in detail at a patent application Ser. No. 721,369 filed on April 9, 1985. The present invention is different from that covered by the prior invention only in the design of swingable arms 2. In the present invention, each swingable arm 2 has a left cutting edge 21 in a form of slightly turning outward so that after penetrating into the earth and during rotation of the ground anchor, the cutting edges 21 can cut the earth first to force the cuttings to go into the inner side of the swingable arms 2. The earth in it will in turn force the swingable arms 2 to open. A recession 22 at the external curved surface of each swingable arm 2 is used to reduce friction between the swingable arm 2 and the earth. By means of this design, the swingable arms 2 located at an appropriate position on the anchor head 1 can extend easier than that of the prior art.

For recovery of steel rod, the present invention is further characterized by a short socket 11 with a plurality of tapered fixing holes 19 for insertion of steel rods 12 from the top of these holes 19. Two semi-conical wedges 16 are fitted to the bottom of each tapered fixing hole 19 to fix each steel rod 12 to the hole 19. The external wall of the fixing hole 19 has a tensile strength smaller than the tensile strength of the steel rod. For instance, if the tensile strength of the steel rod is 18 tons, the thickness of the external wall of the fixing hole 19 is made to have a tensile strength of 12 tons. Then, after application of the ground anchor, normal extractor can be used to extract the steel rods 12 easily since the external wall of the fixing holes 19 will distort and break first because its tensile strength is smaller than that of the steel rod. Consequently, the friction among the semi-conical wedges and steel rod 12 is overcome, the steel rod is easily recoverable.

Figure 4C:
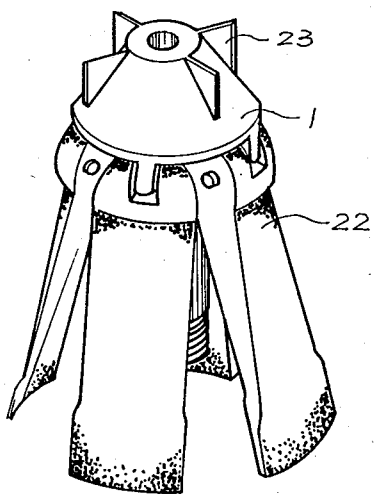
FIGS. 4*a*, 4*b*, and 4*c* show an improved structure of anchor head according to the present invention.
Figure 4B:
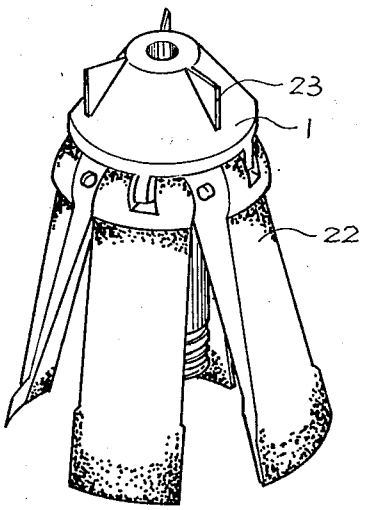
Figure 4A:
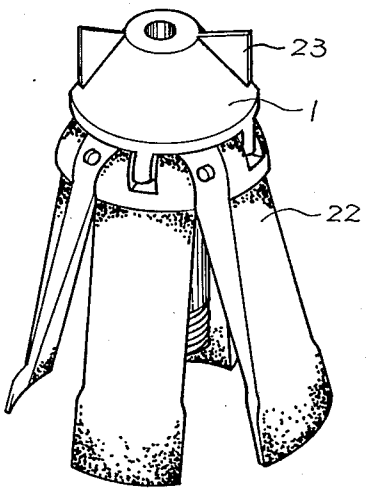

As shown is FIG. 4, while the ground anchor according to the present invention is used at any place where there is no ground water, the drill bit 4, spring 7, and spring-loaded ball 8 may be omitted and a plurality of triangular blades 23 are fixed to the front end of the anchor head 1 directly so that the anchor head 1 can function as a drill bit simultaneously to lower construction cost. The structure illustrated in FIG. 4*a* comprises two triangular blades arranged symmetrically, that in FIG. 4*b* comprises three triangular blades 23 arranged trigonally, and that in FIG. 4*c* comprises four triangular blades 23 arranged in a shape of a cross.

I claim:

1. An improved ground anchor with recoverable steel rods comprising an anchor head, with a water outlet passing through its central line, having a spring-loaded ball and a spring at the lower end of the water outlet, a drill bit fixed to its lower end, a plurality of swingable arms fixed to an appropriate position and an outer thread at its upper end for connecting to an end of a double threaded nut;

a double threaded nut, with an end connected to the anchor head and another end to a hollow rod;

a hollow rod, with its larger end connecting to the double threaded nut so that a thrust bearing, a socket and two washers installed to it will be restricted to the smaller end, and inner thread at the larger end for connecting to a connector;

a thrust bearing, installed at the hollow rod at the position below a socket;

a socket in the form of a short cylinder with a bore slightly greater than the outer diameter of the hollow rod for insertion of the hollow rod, having a plurality of tapered fixing holes for insertion of steel rods from the top, and for insertion of two semi-conical wedges to the bottom of each fixing hole in order to fix the steel rods by frictional force; and a plurality of connectors and connecting tubes to extend the ground anchor to a desired depth, characterized by the design of the external wall of the fixing holes with tensile strength smaller than that of the steel rod so that application of any normal extractor to pull out the steel rods after application of the ground anchor will distort and break the external wall of the fixing holes first, the friction among the semi-conical wedges and steel rods will be overcome consequently, the steel rods can be pulled out and recovered easily.

2. An improved ground anchor with recoverable steel rods as claimed in claim 1 wherein each of the swingable arms has a left cutting edge in a form of slightly turning outward to cut the earth and force the cuttings to go into the inner side of the swingable arms first while the ground anchor is rotating for extension of a base in order to ease extension of the swingable arms, and a recession at the external curved surface to reduce friction between it and the earth.

3. An improved ground anchor with recoverable steel rods as claimed in claim 2 wherein the drill bit, spring and spring-loaded ball in front of the anchor head are omitted but a plurality of triangular blades is fixed to the front end of the anchor head so that the anchor head can function as a drill bit simultaneously in order to lower construction cost while it is being used at any place without qround water.

* * * * *